US009864336B2

(12) United States Patent
Oya

(10) Patent No.: US 9,864,336 B2
(45) Date of Patent: Jan. 9, 2018

(54) IMAGE FORMING APPARATUS

(71) Applicant: CANON KABUSHIKI KAISHA, Tokyo (JP)

(72) Inventor: Yoji Oya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/208,496

(22) Filed: Jul. 12, 2016

(65) Prior Publication Data

US 2017/0017200 A1 Jan. 19, 2017

(30) Foreign Application Priority Data

Jul. 14, 2015 (JP) ..... 2015-140578

(51) Int. Cl.
*G03G 21/20* (2006.01)

(52) U.S. Cl.
CPC ... *G03G 21/206* (2013.01); *G03G 2215/0132* (2013.01); *G03G 2221/1645* (2013.01)

(58) Field of Classification Search
CPC ..... G03G 21/206; G03G 2221/1645
See application file for complete search history.

(56) References Cited

U.S. PATENT DOCUMENTS 6,308,024 B1 * 10/2001 Nakayama ..... B41J 29/12 399/92
8,437,653 B2 * 5/2013 Brown ..... G03D 13/006 399/92
9,411,309 B1 * 8/2016 Kamano ..... G03G 21/206
2006/0120748 A1 * 6/2006 Takehara ..... G03G 15/0194 399/92
2009/0202270 A1 * 8/2009 Brown ..... G03G 15/0817 399/92
2010/0098452 A1 * 4/2010 Inaba ..... G03G 21/1853 399/92
2011/0280609 A1 * 11/2011 Nakazawa ..... G03G 21/206 399/92
2013/0016992 A1 * 1/2013 Watanabe ..... G03G 15/04036 399/92
2013/0142538 A1 * 6/2013 Miwa ..... G03G 21/206 399/92
2013/0164021 A1 * 6/2013 Yoon ..... G03G 21/206 399/92
2014/0140719 A1 * 5/2014 Suzuki ..... G03G 15/0189 399/92
2015/0139683 A1 * 5/2015 Yasui ..... G03G 15/0817 399/102

FOREIGN PATENT DOCUMENTS

JP 2001-138574 A 5/2001
JP 2003-241591 A 8/2003

* cited by examiner

*Primary Examiner* — Ryan Walsh
(74) *Attorney, Agent, or Firm* — Canon USA, Inc. I.P. Division

(57) ABSTRACT

A cooling unit has a cooling fan, a duct configured to guide air supplied from the cooling fan and having a shape extending along an axial direction of a photosensitive member, and a plurality of air outlet portions provided in the duct so as to be apart from each other in the axial direction. Air discharged from the plurality of air outlet portions is supplied to the inside of an image forming unit by utilizing a space as an air duct.

17 Claims, 11 Drawing Sheets

IMAGE FORMING APPARATUS

BACKGROUND OF THE INVENTION

Field of the Invention

The present invention relates to an image forming apparatus that forms an image by using the electrophotographic process, such as a copying machine, a printer, a facsimile machine, or a multifunction printer.

Description of the Related Art

Hitherto, for example, as an electrophotographic image forming apparatus, there is an image forming apparatus in which toner images primarily transferred from photosensitive members of a plurality of image forming units to an intermediate transfer belt are secondarily transferred to a recording medium to output an image. The image forming units each have a photosensitive member, a charging member, a developing member and the like, and are arranged in a row along the moving direction of the intermediate transfer belt.

In such an image forming apparatus, the temperature in the apparatus rises as the operation continues. The causes include accumulation of heat of a fixing unit that fixes a toner image to a recording medium in the main body of the apparatus, heat generation of electric parts such as a motor and a power supply, and frictional heat in a rubbing part of an operating part such as a roller. The temperature rise in the main body of the apparatus causes an image defect. In some cases, toner may adhere to each member. Therefore, it is necessary to provide a fan as a cooling unit in the image forming apparatus, and to suppress the temperature rise in the main body of the apparatus with the fan.

Japanese Patent Laid-Open No. 2003-241591 discloses an opening region that is provided in each image forming unit in order to irradiate a photosensitive member with irradiation light forming an electrostatic latent image. Japanese Patent Laid-Open No. 2003-241591 proposes using this opening region as an air duct to each image forming unit and causing air to flow to each image forming unit through this air duct. Owing to this configuration, the opening region can be used as an air duct, and therefore, the size of the main body of the apparatus can be reduced.

However, in the configuration of Japanese Patent Laid-Open No. 2003-241591, an air supply portion of a duct that guides air supplied from a fan, and an opening portion that is connected to the air supply portion and that guides air into each image forming unit, have a shape such that they widely open in the axial direction of the photosensitive member, and therefore, it is difficult to efficiently cool the photosensitive member, a developing roller, and others.

Image forming apparatuses are desired to be further speeded up. In that case, the peripheral speed of rotating members such as a photosensitive member and a developing roller increases, and therefore, self heat generation in each member also increases. In the case where the opening portion and the air supply portion each have a shape such that they widely open in the axial direction of the photosensitive member, when each member locally significantly generates heat, it is difficult to intensively cool those parts. In the case where the opening portion and the air supply portion have a shape such that they widely open in the axial direction of the photosensitive member, air from the cooling unit is supplied to the entire region in the axial direction of the photosensitive member, and therefore toner may be scattered from each member.

SUMMARY OF THE INVENTION

The present invention provides an image forming apparatus that has a main body reduced in size and that efficiently cools the inside of an image forming unit.

In an aspect of the present invention, an image forming apparatus includes an image forming unit having a photosensitive member and a process member acting on the photosensitive member, a light irradiation unit configured to emit irradiation light for forming a latent image on the photosensitive member, and a cooling unit configured to cool the process member. The image forming unit has an opening portion for allowing irradiation light emitted from the light irradiation unit to the photosensitive member to pass therethrough. The cooling unit has a cooling fan, a duct configured to guide air supplied from the cooling fan and having a shape extending along an axial direction of the photosensitive member, and a plurality of air outlet portions provided in the duct so as to be apart from each other in the axial direction, and air discharged from the plurality of air outlet portions is supplied through the opening portion to the inside of the image forming unit.

Further features of the present invention will become apparent from the following description of exemplary embodiments with reference to the attached drawings.

DESCRIPTION OF THE EMBODIMENTS

Embodiments of the present invention will now be described in detail with reference to the drawings. However, the dimensions, materials, shapes, relative positions, and the like of components described in the embodiments are appropriately changed in accordance with the configuration of an apparatus to which the present invention is applied and various conditions, and are not meant to limit the scope of the invention to the following embodiments.

First Embodiment

Outline of Image Forming Apparatus

Figure 1:
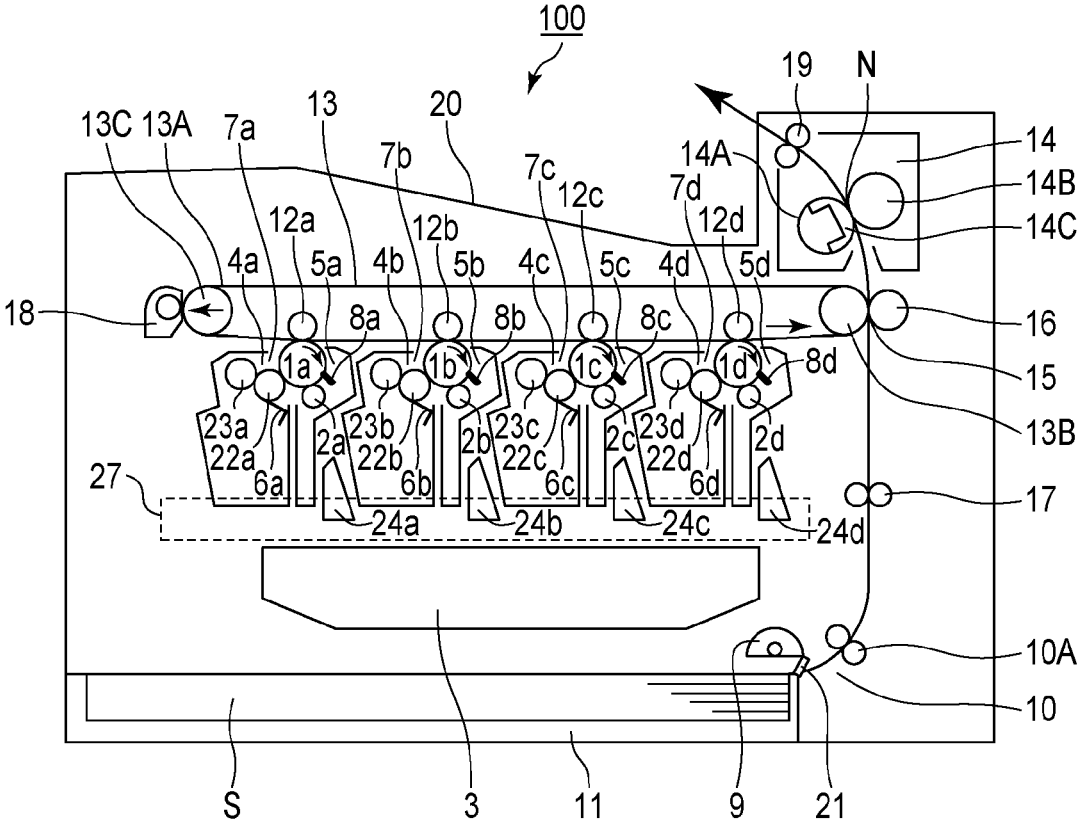
FIG. 1 is a schematic sectional view showing the overall configuration of an image forming apparatus.

FIG. 1 is a schematic sectional view showing the overall configuration of an image forming apparatus. The image forming apparatus 100 has a plurality of photosensitive drums 1 (1*a*, 1*b*, 1*c*, 1*d*) serving as photosensitive members (the subscripts a to d may be omitted in the following description). Each photosensitive drum 1 is made by applying organic photoconductive layer (OPC) to the outer peripheral surface of a cylinder made of aluminum. The photosensitive drum 1 is rotatably supported at both ends by flanges. Driving force is transmitted to one end of the photosensitive drum 1 from a driving motor (not shown), and the photosensitive drum 1 rotates in the direction of arrow of FIG. 1.

Charging units 2 (2*a*, 2*b*, 2*c*, 2*d*), developing units 4 (4*a*, 4*b*, 4*c*, 4*d*), and cleaning blades 8 (8*a*, 8*b*, 8*c*, 8*d*) are disposed around the photosensitive drums 1. Each charging unit 2 has a charging roller that uniformly negatively charges the surface of the photosensitive drum 1. The charging roller is abutted on the surface of the photosensitive drum 1. With this, a charging bias is applied to the charging roller by a power supply (not shown), and the surface of the photosensitive drum 1 is thereby uniformly charged.

In this embodiment, the photosensitive drum 1, the charging unit 2, the developing unit 4, and the cleaning blade 8 are integrally configured, and form an image forming unit serving as a process cartridge 7 (7*a*, 7*b*, 7*c*, 7*d*) that is detachably attachable to the main body of the apparatus. Each process cartridge 7 of this embodiment has a drum unit portion 5 (5*a*, 5*b*, 5*c*, 5*d*) consisting of the developing unit 4, photosensitive drum 1, charging unit 2, and cleaning blade 8. The process cartridge 7 has at least the photosensitive drum 1.

A light irradiation unit 3 is disposed below the image forming units. The light irradiation unit 3 emits light on the basis of image information to form an electrostatic latent image on each photosensitive drum 1. The light irradiation unit 3 is formed by unitizing a semiconductor laser source (not shown) serving as a light source that emits a laser beam P (see FIGS. 4A and 4B), and a drive circuit thereof.

The electrostatic latent image formed on each photosensitive drum 1 is supplied with toner by the corresponding developing unit 4 and is visualized. The detailed configuration of the developing unit 4 will be described later.

The toner image on each photosensitive drum 1 is primarily transferred to an endless intermediate transfer belt 13A opposite thereto. The intermediate transfer belt 13A serving as a transfer belt is stretched over a driving roller 13B and a tension roller 13C serving as stretching rollers. Tension is applied to the tension roller 13C in the direction of arrow of FIG. 1. Primary transfer rollers 12 (12*a*, 12*b*, 12*c*, 12*d*) in contact with the inner peripheral surface of the intermediate transfer belt 13A are provided at positions corresponding to the photosensitive drums 1 (1*a*, 1*b*, 1*c*, 1*d*) with the intermediate transfer belt 13A therebetween. When primarily transferring a toner image from the corresponding photosensitive drum 1 to the intermediate transfer belt 13A, a transfer bias is applied to each primary transfer roller 12 from a high-voltage power source (not shown).

The intermediate transfer belt 13A, the driving roller 13B, the tension roller 13C, and the primary transfer rollers 12 (12*a*, 12*b*, 12*c*, 12*d*) are unitized as an intermediate transfer belt unit 13 and detachably attachable to the main body 100 of the apparatus.

In each cartridge 7, residual toner that is not primarily transferred to the intermediate transfer belt 13A and remains on the photosensitive drum 1 is removed from the photosensitive drum 1 by the corresponding cleaning blade 8 and is recovered into a waste toner container (not shown). In the process cartridges 7, charge, exposure, and development processes are performed, and toner images formed on the photosensitive drums 1 are primarily transferred to the intermediate transfer belt 13A in the order from the photosensitive drum 1*a* disposed on the upstream side, and a color toner image is formed on the intermediate transfer belt 13A.

The intermediate transfer belt 13A rotates in the direction of arrow (counterclockwise), and the toner image transferred to the intermediate transfer belt 13A reaches a secondary transfer portion 15. The secondary transfer portion 15 is formed by a secondary transfer roller 16 and the intermediate transfer belt 13A.

A feeding device 10 has a feeding roller 9 that feeds a recording medium S from a feeding cassette 11 that stores recording media S that are transfer media, and a conveyance roller pair 10A that conveys the fed recording medium S. The feeding cassette 11 is configured so as to be able to be pulled out from the main body of the apparatus. A user pulls out the feeding cassette 11, loads recording media S, and then reinserts the feeding cassette 11 into the main body of the apparatus, and the loading of recording media S is thereby completed.

The recording media S stored in the feeding cassette 11 are pressed by the feeding roller 9, and separated by a separating pad 21, and conveyed one at a time. The recording medium S conveyed from the feeding device 10 is conveyed to the secondary transfer portion 15 by a registration roller pair 17.

In the secondary transfer portion 15, a positive polarity bias is applied to the secondary transfer roller 16 from a secondary transfer power supply (not shown), and the toner image on the intermediate transfer belt 13A is thereby secondarily transferred to the conveyed recording medium S. At this time, the image formed on the recording medium S is an unfixed toner image.

A fixing unit 14 applies heat and pressure to the unfixed toner image transferred to the recording medium S to fix the unfixed toner image to the recording medium S. The fixing unit 14 has a cylindrical fixing belt 14A, an elastic pressure roller 14B, and a belt guide member 14C to which a heating unit such as a heater is attached. The elastic pressure roller 14B pinches the fixing belt 14A between itself and the belt guide member 14C with a predetermined pressure contact force to form a fixing nip portion N having a predetermined width. The elastic pressure roller 14B is rotationally driven by a driving unit (not shown), the cylindrical fixing belt 14A is thereby rotated, and the fixing belt 14A is heated by an internal heater (not shown).

In a state where the fixing nip portion N is warmed up to a predetermined temperature, the recording medium S on which the unfixed toner image is formed is introduced between the fixing belt 14A and the elastic pressure roller 14B of the fixing nip portion N. The recording medium S is introduced with the image surface thereof facing the fixing belt surface. The recording medium S is pinched and conveyed through the fixing nip portion N with the image surface of the recording medium S in close contact with the outer surface of the fixing belt 14A in the fixing nip portion N. In the process in which the recording medium S is pinched and conveyed together with the fixing belt 14A through the fixing nip portion N, the recording medium S is heated by the heat of the heater in the fixing belt 14A, and the unfixed image on the recording medium S is heat-fixed. The recording medium S to which the image is fixed is discharged by a discharge roller pair 19 onto a discharge tray 20. Toner that is not secondarily transferred to the recording medium S in the secondary transfer portion 15 and remains on the intermediate transfer belt 13A is cleaned by a belt cleaning unit 18.

A storage portion, a developing blade 6, a developing roller 22, a toner applying roller 23, a sheet member 28, and end seals 30 of each developing unit 4 will be described later. A main body frame 27 and air supply ducts 24 (24*a*, 24*b*, 24*c*, 24*d*) serving as second ducts will also be described later.

Cooling Unit

Figure 2A:
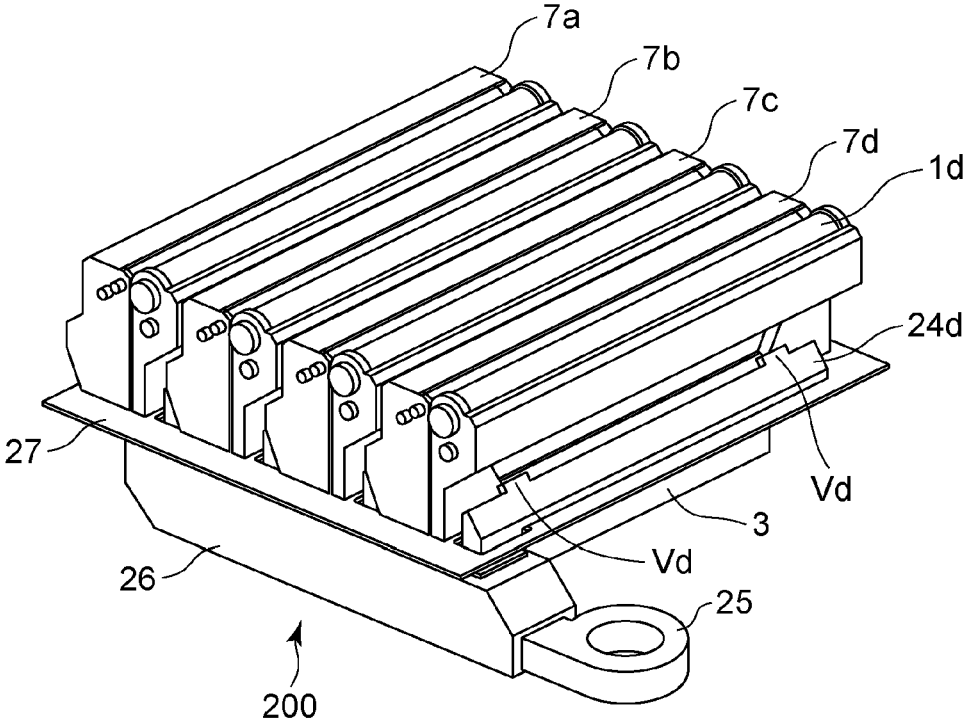
FIG. 2A is a perspective view of process cartridges and a cooling unit for illustrating the cooling unit.
Figure 2B:
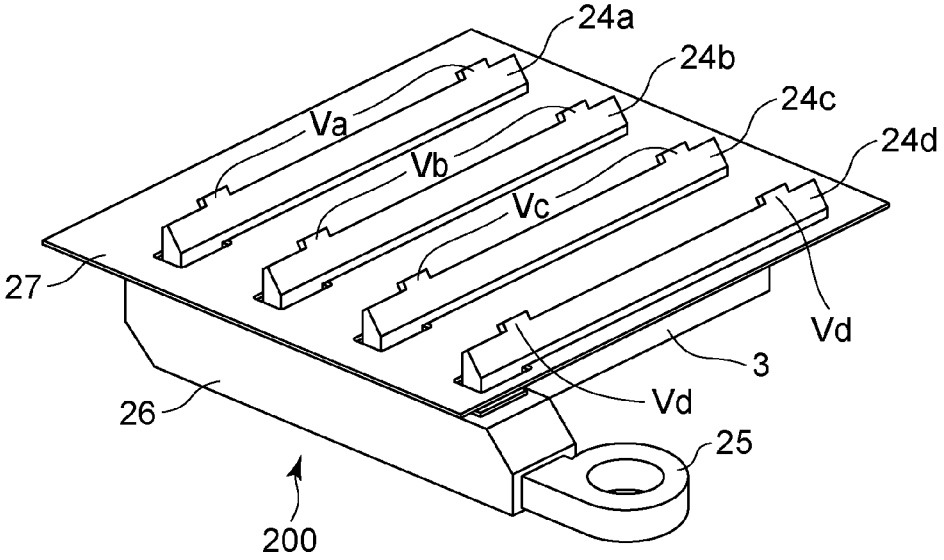
FIG. 2B is a perspective view showing a state in which the process cartridges are removed from FIG. 2A.

Next, a cooling unit of this embodiment will be described. FIG. 2A is a perspective view of process cartridges 7 (7*a*, 7*b*, 7*c*, 7*d*) and a cooling unit for illustrating the cooling unit 200. FIG. 2B is a view showing a state in which the process cartridges 7 (7*a*, 7*b*, 7*c*, 7*d*) are removed from FIG. 2A. The process cartridges 7 (7*a*, 7*b*, 7*c*, 7*d*) are detachably attachable to a main body frame 27 in the axial direction of the photosensitive drums 1.

The cooling unit 200 has a cooling fan 25 that takes in air from the outside into the main body 100 of the apparatus and sends air to the inside of the apparatus, and a common duct 26 that guides the air sent to the inside of the apparatus from the cooling fan 25. The cooling unit 200 further has air supply ducts 24 (24*a*, 24*b*, 24*c*, 24*d*) that are ducts branching from the common duct 26 in correspondence with the process cartridges 7 (7*a*, 7*b*, 7*c*, 7*d*). Air taken in into the apparatus by the cooling fan 25 is supplied to each process cartridge 7 through the common duct 26, the air supply ducts 24, and air outlet portions V, and cools the inside of each process cartridge 7 (the inside of each image forming unit).

The common duct 26 is disposed below the main body frame 27, which is a support member supporting each process cartridge 7, and above the light irradiation unit 3. Each air supply duct 24 is provided with a plurality of air outlet portions V (Va, Vb, Vc, Vd) (supply portions) for supplying air from the air supply duct 24 to the target process cartridge 7, on both sides in the axial direction of the photosensitive drum 1 (the direction of dashed line PP). In other words, the air outlet portions V are formed apart from each other in the axial direction of the photosensitive drum 1.

Figure 3:
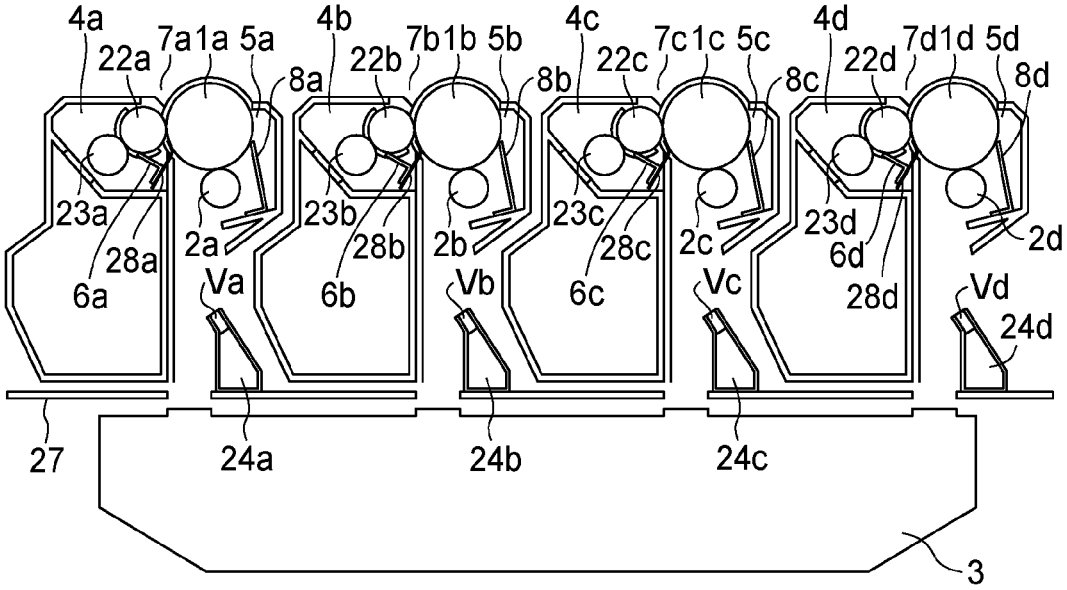
FIG. 3 is a schematic sectional view for illustrating the positional relationship between each process cartridge, the main body frame, the light irradiation unit, and the cooling unit.
Figure 4A:
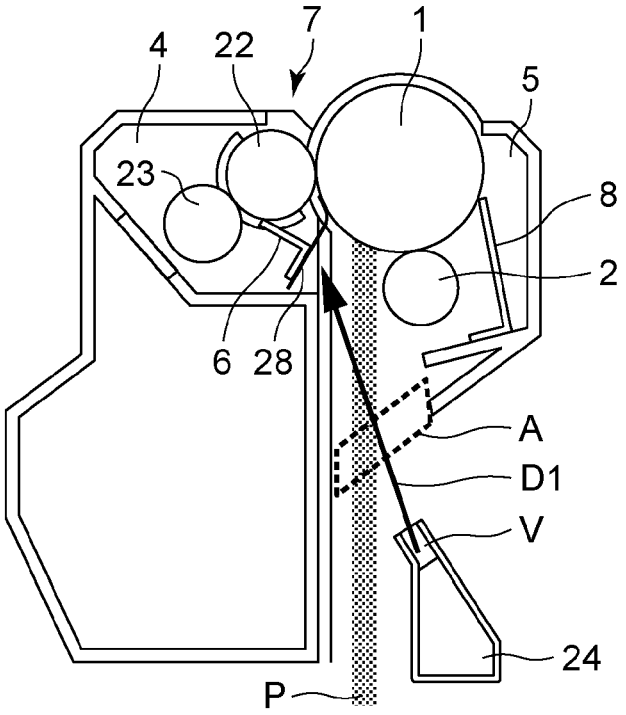
FIGS. 4A and 4B are schematic enlarged views for illustrating an opening portion of each process cartridge.
Figure 4B:
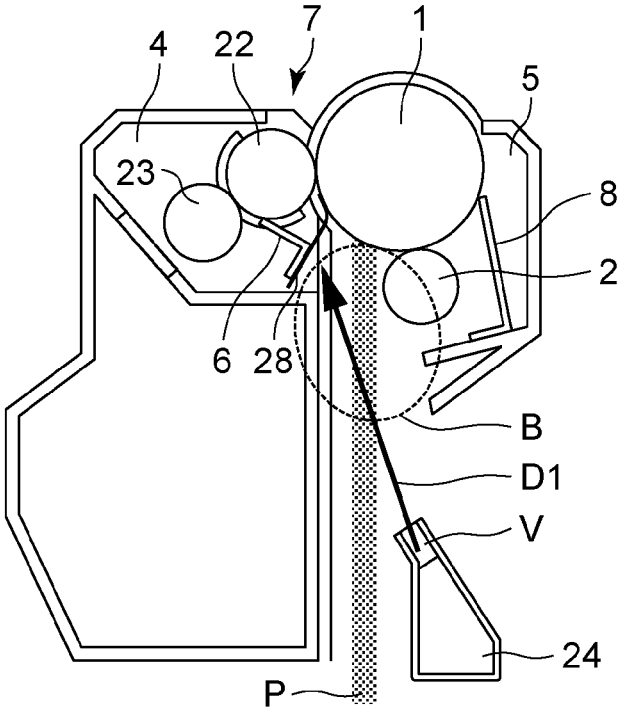

FIG. 3 is a schematic sectional view for illustrating the positional relationship between each process cartridge 7, the main body frame 27, the light irradiation unit 3, and the cooling unit. FIGS. 4A and 4B are schematic enlarged views for illustrating an opening portion A of each process cartridge 7. Because each process cartridge 7 has the same configuration, the subscripts a, b, c, and d are omitted in FIGS. 4A and 4B.

As shown in FIG. 3, the air supply ducts 24*a*, 24*b*, and 24*c* are disposed between adjacent process cartridges 7. The air supply duct 24*d* corresponding to the process cartridge 7*d* disposed most downstream in the rotation direction of the intermediate transfer belt 13A is disposed on the downstream side of the process cartridge 7*d*. For example, when the process cartridge 7*a* is a first image forming unit, and the process cartridge 7*b* is a second image forming unit, the air supply duct 24*a* therebetween is a first duct. When the process cartridge 7*c* is a third image forming unit, the air supply duct 24*b* between the process cartridges 7*b* and 7*c* is a second duct.

Since each air supply duct 24 is disposed between adjacent process cartridges 7 as shown in FIG. 3, the air supply ducts 24 do not limit the arrangement in the height direction of the process cartridges 7 and the light irradiation unit 3, and the process cartridges 7 and the light irradiation unit 3 can be disposed close to each other.

As shown in FIG. 4A, the opening portion A through which air (denoted by D1) supplied from the air outlet portion V is supplied to the inside of each process cartridge 7 also serves as an opening portion for allowing irradiation light P emitted by the light irradiation unit 3 to reach the photosensitive drum 1. The opening portion A is the region shown by dashed line in FIG. 4. The opening portion A serves as both an opening portion for irradiation light P emitted from the light irradiation unit 3 and an opening portion for air supplied from the air outlet portion V. The air outlet portion V and the air supply duct 24 are provided so as not to block irradiation light P emitted from the light irradiation unit 3, and air supplied from the air outlet portion V intersects with irradiation light P and is supplied to the developing unit 4.

Owing to such a configuration, as in the region B shown by dashed line in FIG. 4B, a space that guides irradiation light P from the light irradiation unit 3 to the photosensitive drum 1 of each process cartridge 7 can be used as an air duct for air supplied from the air outlet portion V.

Therefore, in this embodiment, the space in the main body of the apparatus is utilized, and therefore, the size of the whole apparatus can be reduced compared to a configuration in which an air duct is separately formed. By disposing the air outlet portion V on the opposite side of the irradiation light P from the developing unit 4 when seen from the axial direction of the photosensitive drum 1, the space in the main body of the apparatus can be utilized, and the size of the image forming apparatus can be reduced.

Figure 5A:
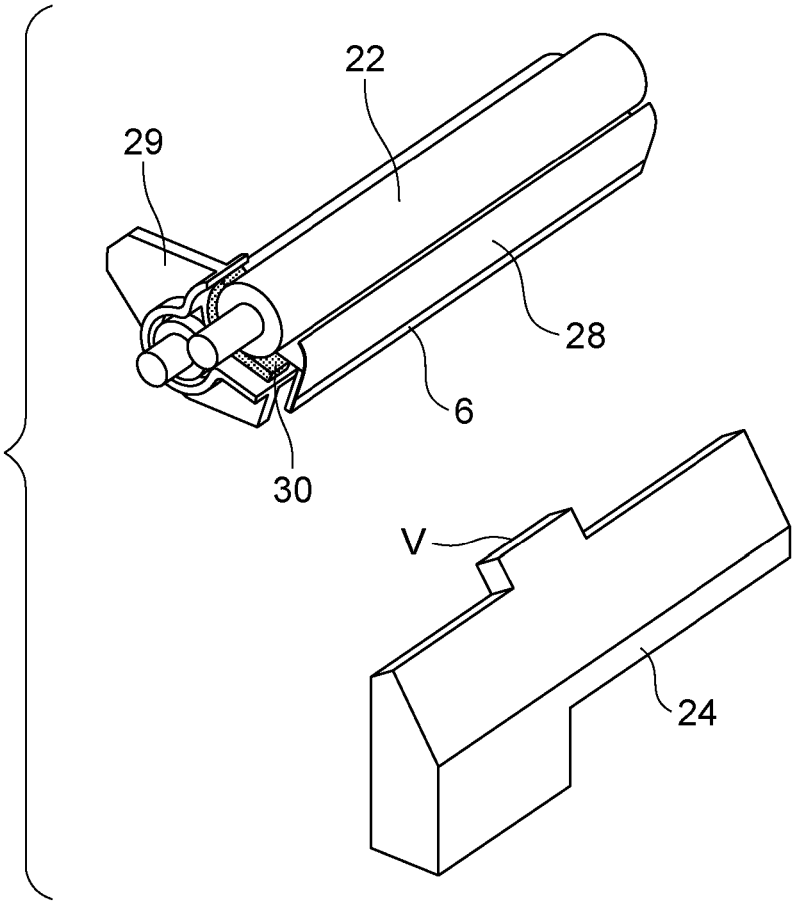
FIG. 5A is a perspective view for illustrating the inside of the developing unit.
Figure 5B:
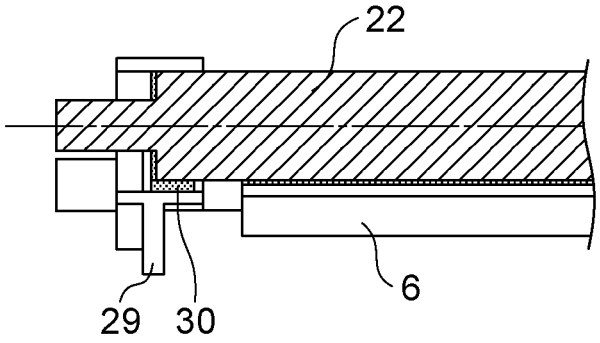
FIG. 5B is a sectional view for illustrating the inside of the developing unit.

The opening portion A is formed in a shape elongated in the axial direction of the photosensitive drum 1 in order to guide irradiation light P emitted by the light irradiation unit 3 to an almost entire region in the axial direction of the photosensitive drum 1. As shown in FIGS. 4A and 4B, the air outlet portion V faces not toward the photosensitive drum 1 but toward the developing unit 4. Positions of air outlet portions V Next, the positions of the air outlet portions V provided in each air supply duct 24 will be described. FIG. 5A is a perspective view for illustrating the inside of the developing unit 4, and FIG. 5B is a sectional view for illustrating the inside of the developing unit 4.

The developing unit 4 of this embodiment is prone to local heat generation at both ends of the developing roller 22. The reason therefor will be described with reference to FIGS. 4A and 4B and FIGS. 5A and 5B. The developing unit 4 includes a storage portion that stores toner, a developing blade 6, a developing roller 22, a toner applying roller 23, a sheet member 28, and end seals 30. A conductive rubber roller or a resin tube is used as the developing roller 22. The developing roller 22 abuts on the surface of the photosensitive drum 1 and is rotationally driven by a driving portion (not shown). A development bias is applied to the developing roller 22 by a development power supply (not shown). An electrostatic latent image formed on the surface of the photosensitive drum 1 is supplied with toner to be developed. The toner applying roller 23 and the developing blade 6 are disposed on the outer peripheral surface of the developing roller 22. A sponge roller is used as the toner applying roller 23. The toner applying roller 23 rotates in contact with the developing roller 22, thereby supplying toner to the developing roller 22. A metal plate is used as the developing blade 6. The developing blade 6 limits the thickness of the toner layer on the developing roller 22. The end seals 30, which are disposed so as to be in contact with the surface of the developing roller 22 at both ends of the developing roller 22, are made of a sponge material or fabric, and play a role in preventing leakage of toner to the longitudinal direction of the developing roller 22. A resin sheet is used as the sheet member 28, which is attached to the developing blade 6. The sheet member 28 prevents toner from falling from the developing unit 4 and adhering to the light irradiation unit 3.

As shown in FIG. 5A, the end seals 30 are disposed at both axial ends of the developing roller 22 and supported by flanges 29 in order to prevent leakage of toner. The end seals 30 have a U-shape and rub on the developing roller 22. As the process speed (the rotation speed of the photosensitive drum 1) increases, the rotation speed of the developing roller 22 also increases, and therefore, frictional heat caused by friction with the end seals 30 increases. This frictional heat causes local heat generation in the developing roller 22, which is one of the process members. So, in this embodiment, the air outlet portions V are disposed in correspondence with regions where local heat generation occurs, and the developing roller 22 is thereby efficiently cooled.

Figure 6:
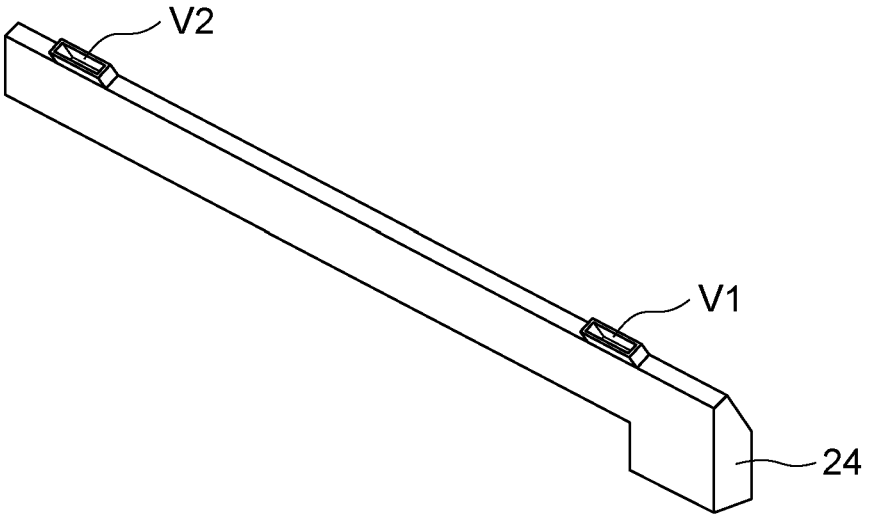
FIG. 6 is a perspective view illustrating the positions of air outlet portions in the axial direction.

Specifically, as shown in FIG. 6, the air outlet portions V are provided at both ends in a longitudinal direction parallel to the axial direction of the photosensitive drum 1. The air outlet portion V1 of FIG. 6 is an air outlet portion nearer to the cooling fan 25 (see FIG. 2). The air outlet portion V1 is disposed at one longitudinal end so as to face the developing roller 22. The air outlet portion V2 is an air outlet portion farther from the cooling fan 25 (see FIG. 2). The air outlet portion V2 is disposed at the other longitudinal end so as to face the other end of the developing roller 22. The air outlet portions V1 and V2 both have a chimney shape protruding from the air supply duct 24 toward the developing roller 22. As shown in FIG. 6, the air supply duct 24 between the air outlet portion V1 and the air outlet portion V2 has a shape that is closed so as not to leak air and that is elongated in the axial direction. Owing to this configuration, air from the cooling fan 25 (see FIG. 2) can be intensively supplied from the air outlet portion V1 and the air outlet portion V2.

Figure 7A:
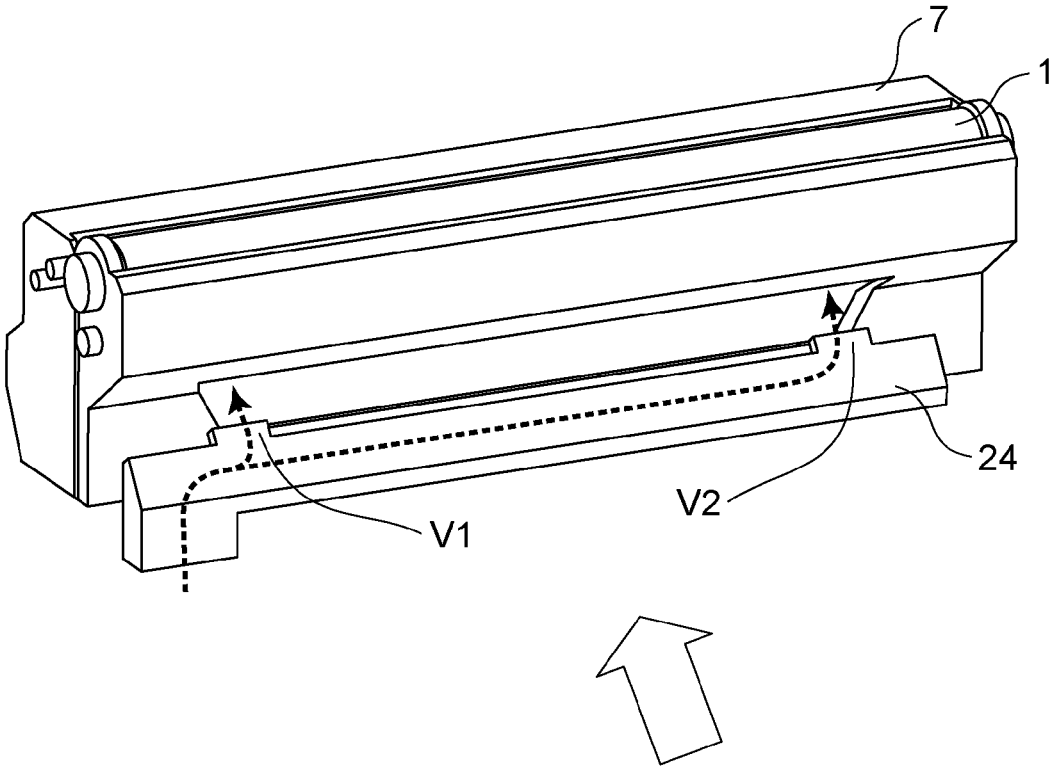
FIG. 7A is a perspective view of the process cartridge, the air supply duct, and the air outlet portions.
Figure 7B:
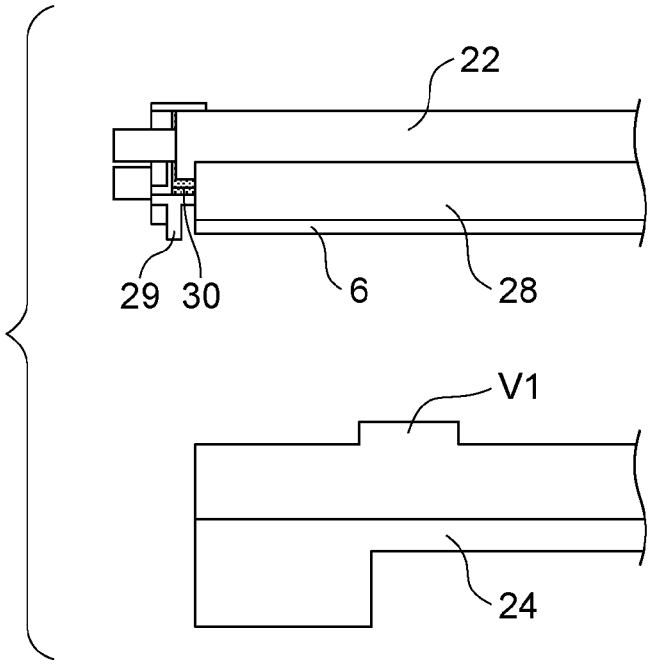
FIG. 7B is a schematic enlarged view of the air outlet portion V1 side.
Figure 8:
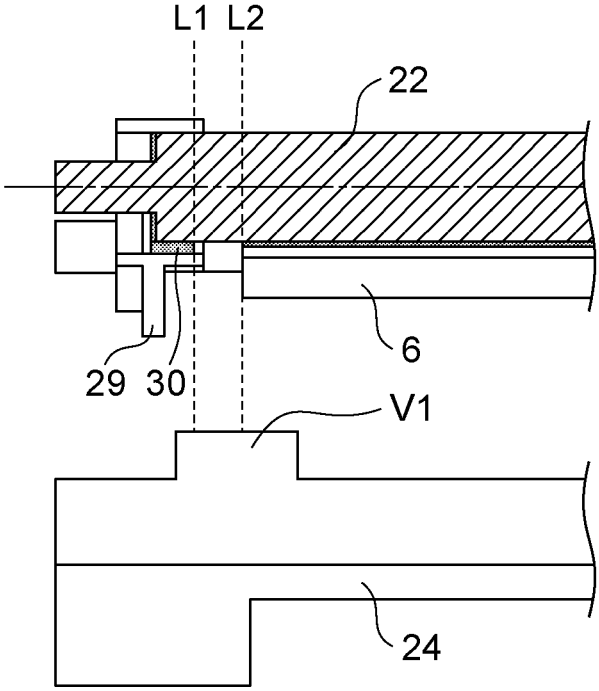
FIG. 8 shows a modification of the arrangement of air outlet portions V.

FIG. 7A is a perspective view of the process cartridge 7, the air supply duct 24, and the air outlet portions V1 and V2 for illustrating the flow of air. FIG. 7B is a schematic enlarged view of the air outlet portion V1 side. As shown in FIG. 7A, the air outlet portion V1 and the air outlet portion V2 are disposed on the axially inner side of both ends of the photosensitive drum 1. FIG. 7B is a view as seen from the arrow side of FIG. 7A. As shown in FIG. 7B, the air outlet portion V1 is disposed on the axially inner side of the developing blade 6 and the end seal 30 (first end seal). Although not shown, the air outlet portion V2 is also disposed on the axially inner side of the developing blade 6 and the end seal 30 (second end seal). Owing to this configuration, air supplied from the cooling fan 25 (see FIG. 2) can be directly delivered to parts of the developing roller 22 where the local temperature rise occurs. As shown in FIG. 8, the air outlet portion V1 may be disposed such that at least part thereof is located on the outer side of the developing blade 6 and at least part thereof is located on the inner side of the end seal 30. In FIG. 8, L1 shows the boundary line of the end seal 30, and L2 shows the boundary line of the developing blade 6. The axial positional relationship between the air outlet portion V1 and the air outlet portion V2 does not necessarily have to be symmetrical as in FIGS. 7A to 8, and their positions may be changed as long as the local temperature rise of the developing roller 22 can be suppressed.

Owing to the above configuration, the air outlet portion V1 and air outlet portion V2 disposed apart from each other can intensively cool the corresponding regions of the developing roller 22, which is a process member. Air supplied from the air outlet portion V1 and the air outlet portion V2 also slightly cools the whole of each process cartridge 7. Although air is blown to the inside of the process cartridge 7, the region to which air is blown is a region on the photosensitive drum 1 on which an electrostatic latent image is formed. Part of the developing roller 22 between the end seals 30 at both axial ends is covered by the sheet member 28. Therefore, there is no fear that toner in the process cartridge 7 is scattered by the blown air.

Second Embodiment

In the first embodiment, a configuration has been described in which air supplied from the air outlet portion V1 and the air outlet portion V2 is directly supplied to the opening portion A of the corresponding process cartridge 7. In this embodiment, air supplied from the air outlet portion V1 and the air outlet portion V2 is guided by the outer frame of the developing unit 4 of the adjacent process cartridge 7, and is supplied to the opening portion A of the corresponding process cartridge 7. Because the other configurations are the same as those of the image forming apparatus of the first embodiment, the same reference signs will be used to designate the same components as those in the first embodiment.

Figure 9:
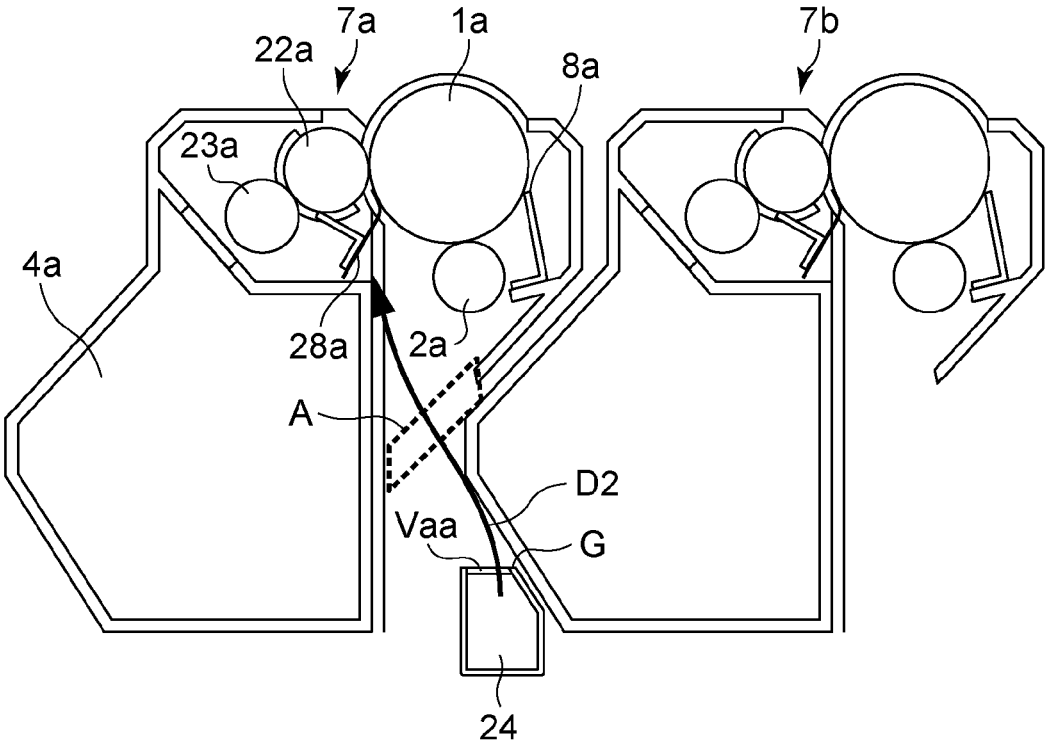
FIG. 9 is a sectional view for illustrating an air outlet portion of a second embodiment.

FIG. 9 is a schematic diagram that illustrates a process cartridge 7*a*, a process cartridge 7*b* adjacent thereto in the moving direction of the intermediate transfer belt 13A, and an air outlet portion Vaa corresponding to the process cartridge 7*a* in order to illustrate the configuration of the second embodiment. As shown in FIG. 9, air D2 supplied from the air outlet portion Vaa is not directed directly to the opening portion A, and it first hits the outer frame G of the developing unit 4*b* of the adjacent process cartridge 7*b*. The outer frame G of the developing unit 4*b* serves as an air guide member G, and guides air in the direction of the opening portion A. Air supplied through the opening portion A to the process cartridge 7*a* cools the developing roller 22 as in the first embodiment.

Owing to this configuration, the developing unit 4*b* of the adjacent process cartridge 7*b* can be cooled, and the developing unit 4*b* of the process cartridge 7*b* can be cooled while suppressing the local temperature rise of the developing roller 22*a* of the process cartridge 7*a*. The cooling unit between the process cartridge 7*b* and the process cartridge 7*c*, and the cooling unit between the process cartridge 7*c* and the process cartridge 7*d* can also have the same configuration.

Other Embodiments

Figure 10:
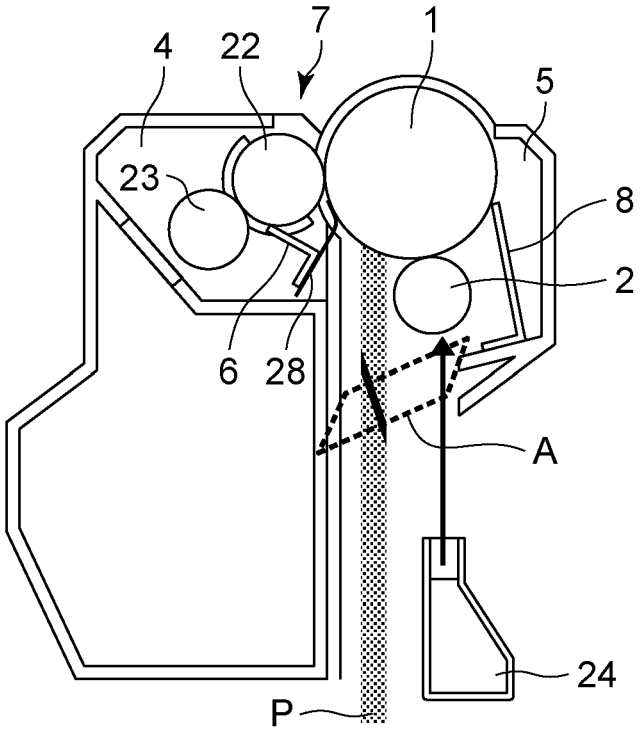
FIG. 10 is a sectional view illustrating the configuration of a cooling unit that cools a charging roller.

Although, in the above embodiments, air supplied from the air outlet portions V is directed to the developing roller 22, air may be directed to any other process member. For example, as shown in FIG. 10, air may be directed to the charging roller 2. As long as air is supplied through the opening portion A, the positions of the air outlet portions V1 and V2 can be changed according to the position of the object to be cooled.

When more than two places are desired to be intensively cooled, the number of air outlet portions V may be increased. However, if the number of air outlet portions V is increased, air supplied from the fan 25 is branched, and therefore, cooling capacity per local region decreases. Therefore, the number of air outlet portions V can be increased as long as the local temperature rise can be sufficiently suppressed. The protruding shape of the air outlet portions V may be changed in consideration of the degree of temperature rise of the object to be cooled.

Figure 11:
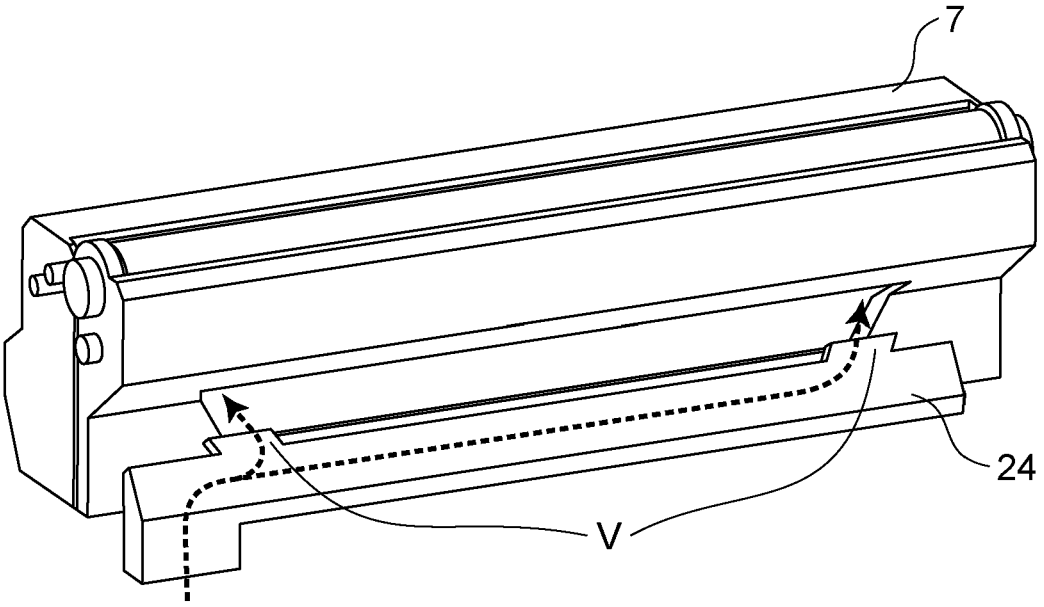
FIG. 11 illustrates a modification of air outlet portions.

The direction in which the air outlet portions V protrude is not limited to a straight direction. For example, as shown in FIG. 11, the air outlet portions V may have a shape such that they are inclined from the inner side to the outer side. When the air outlet portions V have such a shape, air can be supplied from the inner side of the targeted developing roller to the outer side thereof, air can be prevented from being supplied to the inner side corresponding to the image forming region, and the scattering of toner can be reduced.

Although, in the first and second embodiments, the image forming apparatus has an intermediate transfer belt 13A as a transfer belt, a conveying belt that bears and conveys a recording medium P may be used as a transfer belt. When the present invention is applied to an image forming apparatus having a single image forming unit, the same advantageous effect can also be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-140578, filed Jul. 14, 2015, which is hereby incorporated by reference herein in its entirety.

What is claimed is:

1. An image forming apparatus comprising:

an image forming unit having a photosensitive member and a developing unit configured to develop an electrostatic latent image formed on the photosensitive member;

a light irradiation unit configured to emit irradiation light for forming a latent image on the photosensitive member; and a cooling unit configured to cool the image forming unit, the cooling unit has a cooling fan, a duct configured to guide air supplied from the cooling fan and having a shape extending along an axial direction of the photosensitive member, and a plurality of air outlet portions provided in the duct so as to be apart from each other in the axial direction, wherein the image forming unit has an opening portion for allowing irradiation light emitted from the light irradiation unit to the photosensitive member to pass therethrough, air discharged from the plurality of air outlet portions is supplied through the opening portion to the inside of the image forming unit, when viewed from the axial direction of the photosensitive member, the developing unit is located at one side and the plurality of air outlet portions is located at opposite side, and the light irradiated from the light irradiation unit goes between the one side and the opposite side.

2. The image forming apparatus according to claim 1, the developing unit has a developing roller configured to supply toner to the photosensitive member.

3. The image forming apparatus according to claim 2, wherein the plurality of air outlet portions have a shape protruding from the duct toward the developing roller.

4. The image forming apparatus according to claim 3, wherein the duct is disposed on the opposite side of the irradiation light from the developing unit when seen from the axial direction of the photosensitive member.

5. The image forming apparatus according to claim 3, wherein the plurality of air outlet portions comprise a first air outlet portion provided at a first end of the duct in the axial direction and a second air outlet portion provided at a second end of the duct in the axial direction.

6. The image forming apparatus according to claim 5, wherein the developing unit has a first end seal configured to cover an end of the developing roller on the first end side and a second end seal configured to cover an end of the developing roller on the second end side, and at least part of the first air outlet portion is located on the inner side of the first end seal in the axial direction.

7. The image forming apparatus according to claim 6, wherein at least part of the second air outlet portion is located on the inner side of the second end seal in the axial direction.

8. The image forming apparatus according to claim 5, wherein the developing unit has a developing blade configured to abut on the developing roller and to limit the thickness of a toner layer of the developing roller, and both ends of the developing blade are located on the inner side of both ends of the developing roller in the axial direction.

9. The image forming apparatus according to claim 8, wherein at least part of the first air outlet portion is located on the outer side of the developing blade in the axial direction.

10. The image forming apparatus according to claim 9, wherein at least part of the second air outlet portion is located on the outer side of the developing blade in the axial direction.

11. The image forming apparatus according to claim 5, wherein the first air outlet portion protrudes while inclining from the inner side to the outer side in the axial direction.

12. The image forming apparatus according to claim 11, wherein the second air outlet portion protrudes while inclining from the inner side to the outer side in the axial direction.

13. The image forming apparatus according to claim 1, further comprising an endless transfer belt for transferring a toner image from the photosensitive member of the image forming unit to a recording medium.

14. The image forming apparatus according to claim 13, wherein the image forming unit is a first image forming unit, the photosensitive member is a first photosensitive member, the duct is a first duct, and the plurality of air outlet portions is a first plurality of air outlet portions, the image forming apparatus further comprises a second image forming unit disposed on the downstream side of the first image forming unit in the moving direction of the transfer belt, the second image forming unit has at least a second photosensitive member, the cooling unit further has a second duct configured to guide air supplied from the cooling fan and having a shape extending along an axial direction of the second photosensitive member, and a second plurality of air outlet portions provided in the second duct so as to be apart from each other in the axial direction of the second photosensitive member, and air discharged from the second plurality of air outlet portions is supplied to the inside of the second image forming unit by utilizing a space in the second image forming unit through which irradiation light emitted from the light irradiation unit to the second photosensitive member passes, as an air duct.

15. The image forming apparatus according to claim 14, wherein the cooling unit further has a common duct configured to guide air from the cooling fan to the first duct and the second duct.

16. The image forming apparatus according to claim 14, wherein the first duct is provided in a space between the first image forming unit and the second image forming unit.

17. The image forming apparatus according to claim 1, wherein the image forming unit is a process cartridge that is unitized and detachably attachable to the main body of the apparatus.

* * * * *